US006123214A

United States Patent [19]

Goebel

[11] Patent Number: 6,123,214

[45] Date of Patent: Sep. 26, 2000

[54] MULTIPLE CHAMBERED CONTAINER

[76] Inventor: Scott A. Goebel, 5607 Nall Ave., Mission, Kans. 66202

[21] Appl. No.: 08/942,009

[22] Filed: Sep. 30, 1997

Related U.S. Application Data

[62] Division of application No. 08/584,323, Jan. 16, 1996, abandoned.

[51] Int. Cl.[7] ..... B65D 6/00

[52] U.S. Cl. ..... 220/23.4; 220/520; 206/805

[58] Field of Search ..... 220/23.4, 520, 220/500, 553; 206/805

[56] References Cited

U.S. PATENT DOCUMENTS

| | | | |
|---|---|---|---|
| 2,695,238 | 11/1954 | Ferguson | 220/520 |
| 3,116,738 | 1/1964 | Wentges | 206/805 |
| 3,331,105 | 7/1967 | Gordon | 206/805 |
| 3,561,595 | 2/1971 | Weggeland | 206/805 |
| 4,034,926 | 7/1977 | Wegner | 206/805 |
| 4,533,052 | 8/1985 | Fruchey et al. | 206/805 |
| 5,242,071 | 9/1993 | Goebel | 220/520 |

*Primary Examiner*—Joseph M. Moy

*Attorney, Agent, or Firm*—Spencer Fane Britt & Browne LLP

[57] ABSTRACT

A container presenting multiple compartments is provided wherein separable container sections are joined to provide a single container capable of holding multiple different substances and while maintaining separation between the substances.

4 Claims, 3 Drawing Sheets

MULTIPLE CHAMBERED CONTAINER

This application is a division of application Ser. No. 08/584,323, filed Jan. 16, 1996, now abandoned.

BACKGROUND OF THE INVENTION

This invention relates to containers for food and beverages, in particular a cup-type container is provided having multiple mateable sections which are joinable to provide a single container having multiple separated internal compartments for holding substances.

Reference is made to U.S. Pat. No. 5,242,071 to Goebel wherein a stackable multi-compartmental container is described which provides for separated storage in a single container of multiple substances. The container of U.S. Pat. No. 5,242,071 teaches a multi-compartmental container in which the container sections are partially separable at the lower portion to allow for stacking of the containers while the upper portion of the sections of the container are hingedly connected.

The container of Goebel U.S. Pat. No. 5,242,071 presents a manufacturing cost consideration in that it is best constructed using a plastic injection mould process which permits forming of the integral hinge means between the two halves and permits accurate formation of the locking means to hold together the two container portions. Such injection molding is of a higher cost than other molding methods. It would be advantageous therefore to provide such a multiple chambered container which is adapted to other plastic molding methods.

On-site sales of food and drinks has become a principal consumer industry in the United States and the world. Typically, a consumer is offered a selection of foods and beverages from which to select and then carry-out from the point of purchase for consumption. Another common situation is the movie theater concession stand at which a selection of food and beverages is offered for on-site consumption. However, the consumer must carry the selection to a relatively distant point from the concession stand before consuming the selection. In the case of soft drinks, and other beverages a wide selection of flavors is available and the consumer may desire more than a single beverage flavor.

Individuals may, at different times, desire to use a limited number of containers. A young couple may desire different flavored beverages in a single container as a means of facilitating romance. Later, as a parent with a young child, the couple may desire to use a single container having different flavored beverages to assist in controlling the product of that romance. In the case where the child is too small to securely hold a drink container, the multi-compartmental container allows the parent to hold a single container with the parent's drink flavor and the child's drink flavor. This then allows the parent to manipulate a single container in one hand while having the other hand free to deal the child or perform other activities.

Another situation in which a subdivided container is useful is when a consumer wishes to have both food and drink and would like to avoid having both hands filled with containers. A subdivided container which can maintain two substances separately from one another allows the consumer to purchase both a drink and a food, such as popcorn. Another situation is the case when a consumer at a movie theater would like both buttered and plain popcorn. Rather than manipulate two containers, the two different types of popcorn can be placed in a single container and maintained in separated fashion.

While there are numerous opportunities where a subdivided container would be desired, a common drawback to previous designs relates to the storage of such containers prior to their use. In order to save storage space it is preferred that the empty containers either fold flat or be stackable—one within the other. While folded paper containers or containers having a fold-out paper divider can be stored flat, they usually are only able to separately contain solids. Any liquid placed in such containers is able to migrate into the other side of the container or out of the container altogether. If a molded plastic divided container is used, the internal divider is usually fixed in place and immobile. This prevents stacking of the empty containers and results in consumption of a substantial amount of storage space by the empty containers.

Therefore, it would be useful and beneficial to provide a multi-compartment storage container which is capable of holding both solids and liquids simultaneously while maintaining separation between the various substances while permitting efficient storage of the empty containers prior to use. In addition it is preferred if the design of the multi-compartment storage container is adapted to being manufactured without an injection mould process in order to maintain low cost of manufacture.

SUMMARY OF THE INVENTION

It is a principal object of the present invention to provide a storage container capable of holding, in separated compartments, both solids and liquids.

It is another object of the present invention to provide a storage container which provides separated compartments for holding different substances and which can be stacked one-within-another in order to reduce the amount storage space needed for the stock of unused containers.

Another object of the present invention is to provide a multi-compartment container in which the container sections may be manufactured as separate sections and which can be rapidly and easily assembled prior to use.

Yet another object of the present invention is to provide a storage container which provides separated compartments for holding different substances and which can be manufactured while avoiding the use of injection mould manufacturing techniques.

Another object of the present invention is to provide a multiple compartment storage container which is adapted to being manufactured without the use of a high cost injection mould.

These objects and other benefits of the inventive multi-compartment container can be achieved in a container comprising a first storage section having at least one sidewall for mateable connection to a complemental sidewall of a second storage section and a bead on said first sidewall registerable within an indent on said complemental sidewall to secure together said first and second sections, with a first flange on an upper edge of said first sidewall for capture thereunder of an upper edge of said complemental sidewall and a second flange extending from a lower edge of said first sidewall for supporting a lower edge of said complemental sidewall said first and second flanges supportably interlocking said first and second storage sections to form a container such that when said first section or said second section is grasped by a user the section interlocked thereto remains in attachment to provide said formed container with a divided interior.

The foregoing and other objects are not meant in a limiting sense, and will be readily evident upon a study of the following specification and accompanying drawings comprising a part thereof.

DETAILED DESCRIPTION OF THE PREFERRED EMBODIMENTS

Figure 1:
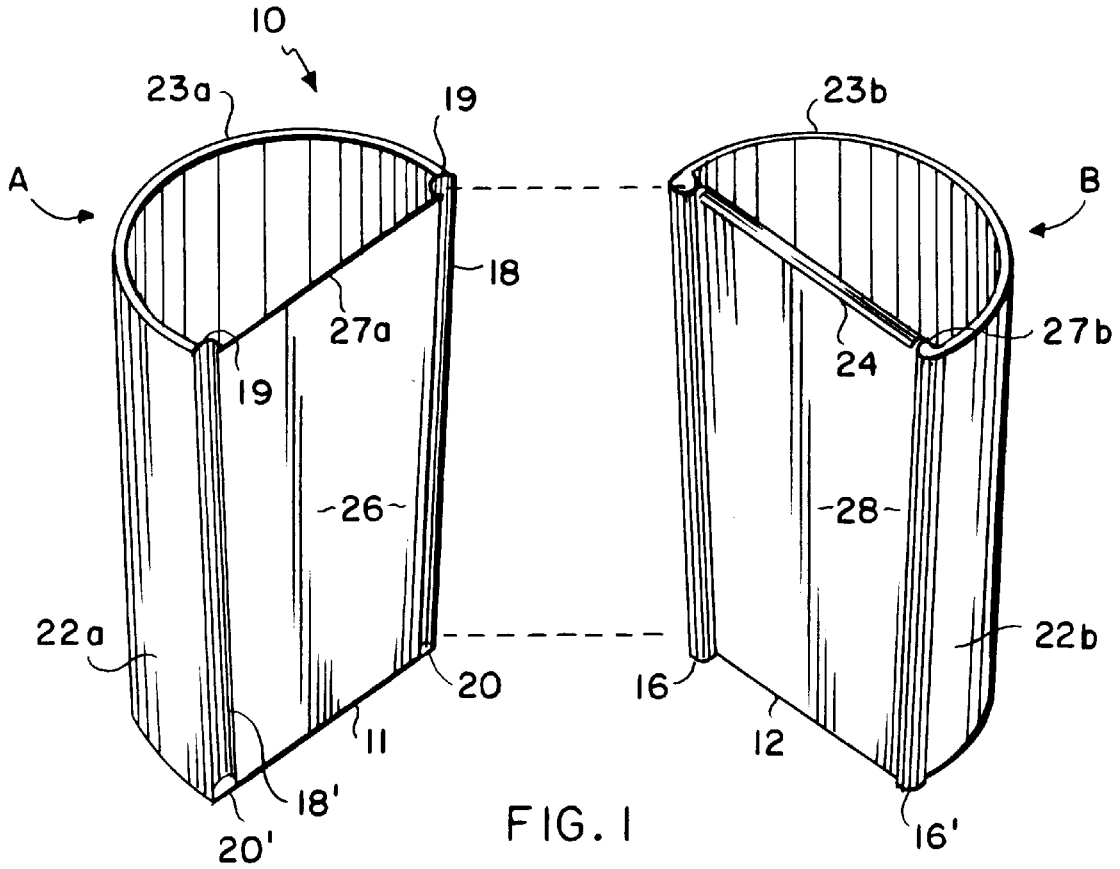
FIG. 1 is an exploded perspective view of an embodiment of the inventive container showing a side positioned bead and indent connection and support flanges at the base of the indents and a securing flange at the top edge of half B.

Referring now to FIG. 1 an embodiment of the inventive container 10 is shown separated into first container half or container section A and second container half or section B. Container sections or halves A & B are designed to mateably couple to form a single container providing two separated compartments for storage of solids or liquids. Container half A is comprised of outer wall 22*a* which, generally, forms half of a cylinder and which is enclosed by container bottom 30 (FIG. 2) and mateable wall 26. Mateable wall 26 is a generally flat surface extending from container bottom 30 (FIG. 2) to near upper edge 23*a* of outer container wall 22*a*.

Container half A is provided with indents or coupling channels 18, 18' which are disposed, in the embodiment of FIG. 1, at the intersection of outer wall 22*a* and mateable wall 26. Coupling channels 18, 18' are vertically disposed indents or recesses which extend from bottom 30 upwardly to upper edge 23*a* of outer wall 22*a* and top edge 27*a* of mateable wall 26. Coupling Channels 18, 18' are adapted to receive, and hold by frictional fit, coupling beads or projections 16, 16' of mateable wall 28 of container half B thereby providing a means for securing section A to section B. Coupling channels 18, 18' may have an open channel top 19, as shown in FIG. 1, or channel top 19 may be closed by a flange similar to flange 20, 20' to provide greater strength between top edge 27 of wall 26 and upper edge 23*a* of outer wall 22*a* and further support for halves A & B upon interconnection. The portion of coupling channels 18, 18' near bottom 30 (FIG. 2) is closed in the embodiment of FIG. 1 by support flanges 20, 20' which serve to support and interlock container half B when it is connected to container half A. Support flanges 20, 20' also may extend from lower edge 11, 12 of sidewalls 26, 28' to supportably engage lower edge 11, 12 of the complemental sidewall of opposed section A or B. It will be appreciated by those skilled in the art that where sufficient support for second container half B is provided by the connection of coupling channels 18, 18' and coupling beads 16, 16' alone, that the inclusion of flanges 20, 20' may be eliminated. Particularly, this might be the case when container 10 is intended for use with materials such as popcorn and other light weight objects.

Still referring to FIG. 1, second container half B is shown which also is, generally, one half of a cylinder. Second container half B is comprised of outer wall 22*b* which is enclosed by mateable wall 28. Mateable wall 28 of container half B is formed to have a complementary fit against mateable wall 26 of container half A. The lower edge of outer wall 22*b* of second container half B is attached to bottom 32 (FIG. 2) which extends to connect to mateable wall 28 to enclose the bottom of second container half B. Second container half B is provided with coupling beads 16, 16' which are disposed, in the embodiment of FIG. 1, at the intersection of outer wall 22*b* and mateable wall 28. Coupling beads 16, 16' extend along the height of second container half B from bottom 32 (FIG. 2) to upper edge 23*b* of outer container wall 22*b*. Coupling beads 16, 16' are adapted to be received within coupling channels 18, 18' of first container half A and form a secure friction fit connection.

The actual registration of coupling beads 16, 16' in coupling channels 18, 18' may be accomplished in either of two ways. First, by manually press fitting beads 16, 16' into channels 18, 18'. Second, by positioning second container half B adjacent, and above, first container half A such that beads 16, 16' are vertically aligned with channels 18, 18' and then sliding container half B downwardly such that beads 16, 16' slide into coupling channels 18, 18' until container half A and container half B are completely joined and mateable wall 26 is opposite mateable wall 28 or until the downward movement of half B is terminated by contact of bead 16, 16' with flange 20, 20' of half A.

While the embodiment of FIG. 1 may be constructed from material which is sufficiently rigid so that the coupling of beads 16, 16' within coupling channels 18, 18' alone is sufficient to secure together container half A and container half B, additional components may be used to reinforce the connection between half A and half B and to provide a means for supportably interlocking sections A & B. One such component is shown in FIG. 1 on half B as curved connection flange or lip 24 which is disposed along top edge 27*b* of mateable wall 28. In use, curved connection flange 24 couples with top edge 27*a* of mateable wall 26 of half A. The connection can be accomplished by either press fitting such that curved connection flange 24 is forced over top edge 27*a* of mateable wall 26, or when second container half B is pushed downwardly to slide beads 16, 16' into channels 18, 18' curved connection flange 24 will, at the termination of downward movement, be disposed over top edge 27*a* of mateable wall 26 such that top edge 27*a* is captured between curved flange 24 and mateable wall 28 of half B. It will be appreciated that curved flange 24 may be placed on top edge 27*a* of container A in order to capture top edge 27*b* of half B.

Figure 2:
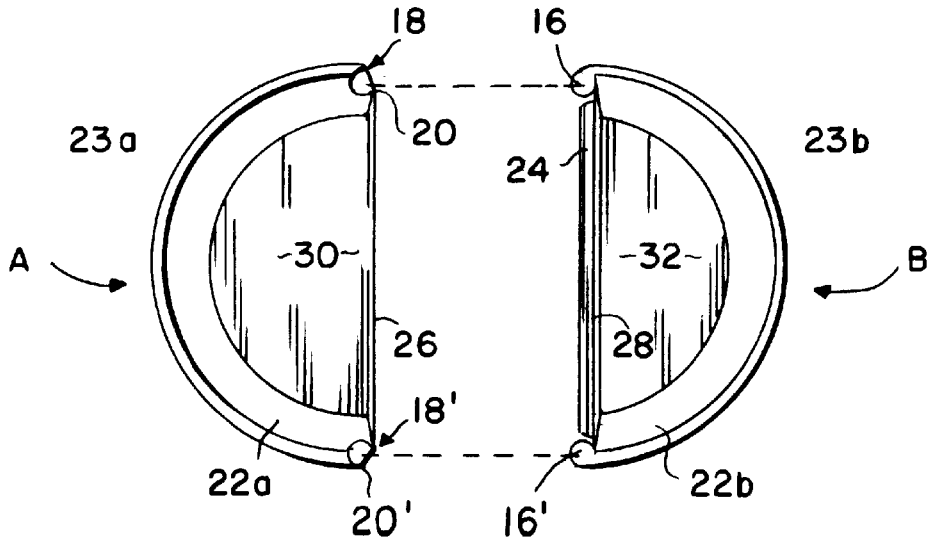
FIG. 2 is a top plan view of the embodiment of FIG. 1 with the container halves separated, but aligned for attachment together.

Referring now to FIG. 2, the relationship between the component parts of first container half A and second container half B can be viewed from above and the interrelationship between coupling beads 16, 16' and channels 18, 18' just prior to connection may be appreciated. It will be observed from FIG. 2, that when container half A is connected to container half B that the two adjacent container halves A & B become interconnected to form container 10 which provides for placement of different substances in halves A & B while maintaining the substances in two distinct areas of container 10.

Figure 3:
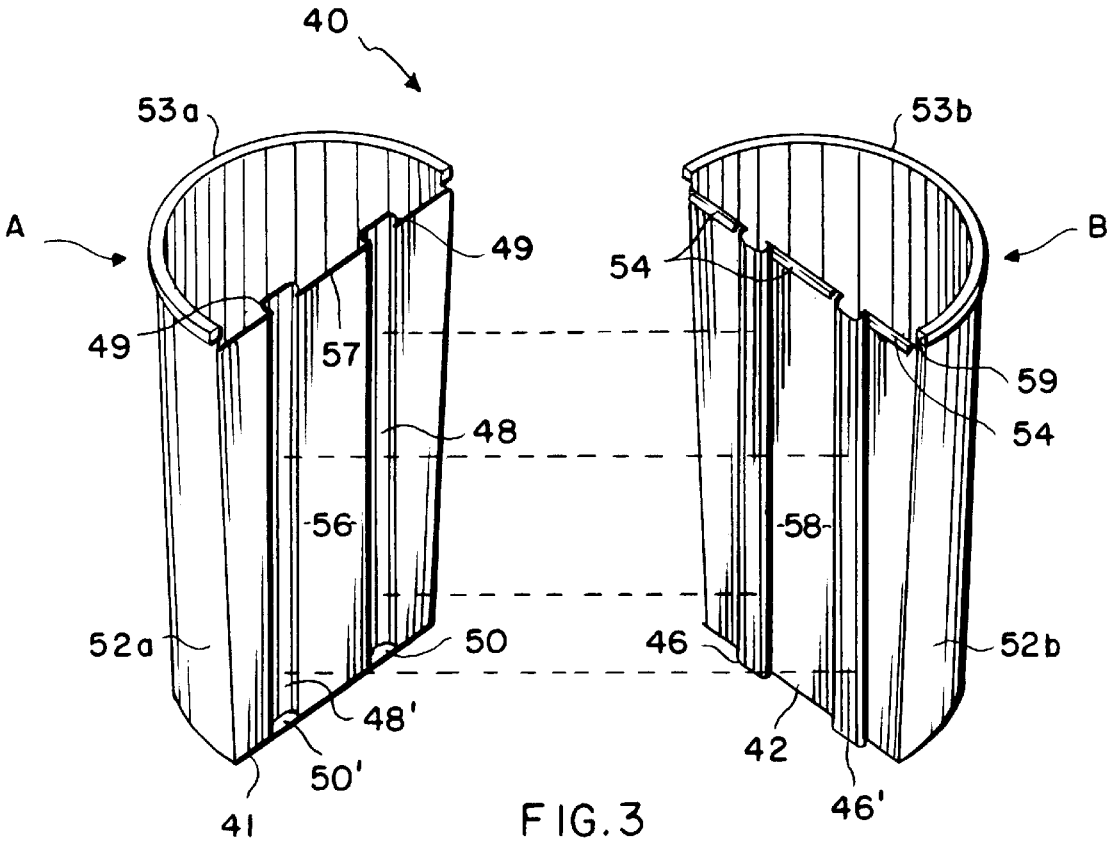
FIG. 3 is a perspective view of an alternative embodiment of the inventive container showing a centrally positioned bead and indent connection and support flanges at the base of the indents and a securing flange at the top edge of half B.

Referring now to FIG. 3, an alternative embodiment, multiple chambered container 40, is shown. The embodiment of FIG. 3 is similar to FIG. 1, however, in the embodiment of FIG. 3 the coupling channels 48, 48' and the coupling beads 46, 46' are disposed inwardly from the intersection of outer walls 52*a*, 52*b* with mateable walls 56, 58 and curved flange 54 is segmented.

In the embodiment of FIG. 3 container 40 is comprised of container half A and container half B which, generally, comprise first and second halves of a cylinder. It will be appreciated by those skilled in the art that while the embodiments shown indicate a generally cylindrical shaped containers 10 and 40, the overall shape of the container can be varied as may be preferred.

The specific construction of container half 40 comprises container half A which presents outer wall 52*a* which connects to mateable wall 56. Mateable wall 56 is adapted for a flush, complemental fit with mateable wall 58 of container half B. Mateable wall 56 of container half A extends from container half bottom 60 (FIG. 4) upwardly to wall top 57. Mateable wall 56 extends to either side to connect with outer wall 52*a*. Mateable wall 56 is provided with coupling indents or channels 48, 48' which are adapted to receive coupling beads 46, 46' within in channels 48, 48' to thereby secure and hold together by friction fit container half A and container half B.

Container half B of container 40 is comprised of outer wall 52*b* which connects to mateable wall 58 to form container half B. The lower extremity of container half B is enclosed by bottom 62 (FIG. 4) which extends to connect to outer wall 52*b* and mateable wall 58. Disposed on mateable wall 58, to permit the securing together of container half A to container half B, are coupling beads 46, 46' which project outwardly from mateable wall 58 and are shaped for registerable reception within indents or coupling channels 48, 48' on mateable wall 56. Halves A & B are held together by a frictional fit of beads 46, 46' within coupling channels 48, 48' when halves A & B are interconnected. Along wall top edge 59 of mateable wall 58 is disposed curved flange 54 which functions to engage and secure wall top edge 57 of container half A between curved flange 54 and top edge 59 of container half B when halves A & B are joined to form container 40.

The connecting of container half A and container half B of FIG. 3 to form container 40 functions similarly to that previously described for the embodiment of FIG. 1. Depending upon the flexibility of the material used to produce container half A and container half B, coupling beads 46, 46' may be press fitted into coupling channels 48, 48' to be held therein by a frictional fit between channels 48, 48' and beads 46, 46'. When such a press fitting between halves A & B is utilized curved connection flange 54 is pressed over wall top edge 57 of half A in order to provide additional securing together of the upper portions of half A to half B. Again, it will be appreciated by those skilled in the art that where the material used to construct container half A and container half B is of sufficient rigidity, the inclusion of curved connection flange 54 may not be required and coupling channels 48, 48' and beads 46, 46' may be entirely sufficient to secure container half A to container half B to form container 40.

As an additional means of support for the connection between container half A and container half B, support flanges 50, 50' may be included at the point at which coupling channels 48, 48' contact bottom 60 of container half A. Support flanges 50, 50' also may extend from lower edge 41, 42 of sidewalls 56, 58' to supportably engage lower edge 41, 42 of the complemental sidewall of opposed section A or B. When flanges 50, 50' are included in coupling channels 48, 48' coupling beads 46, 46' are inserted into channels 48, 48' until they come to rest on support flanges 50, 50'. Once again, depending on the strength of the material used to construct container halves A & B, the inclusion of flanges 50, 50' or curved flanges 54 may be optional.

Figure 4:
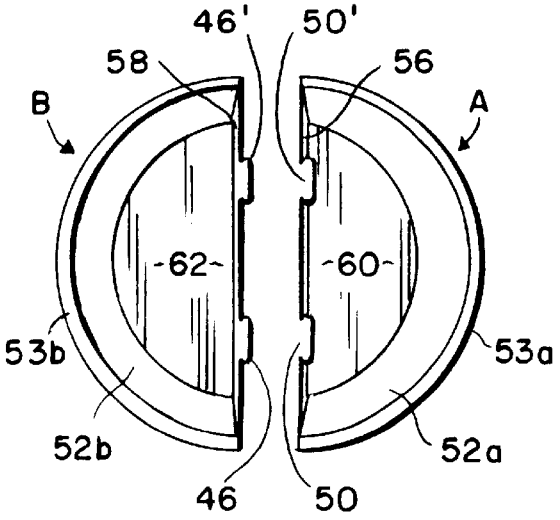
FIG. 4 is a top plan view of the embodiment of FIG. 3 with the container halves separated but, aligned for attachment together.
Figure 5:
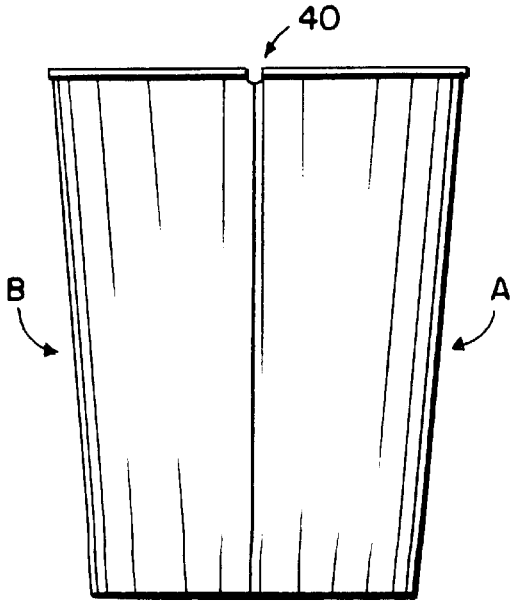
FIG. 5 is a side elevational view of the embodiments of FIGS. 3 & 4 with the two container halves attached for use.

Referring now to FIG. 4, a top plan view of container halves A & B is presented with each half slightly spaced from the other to show the alignment between halves A & B just prior to connection to form container 40 of FIG. 5.

Figure 6:
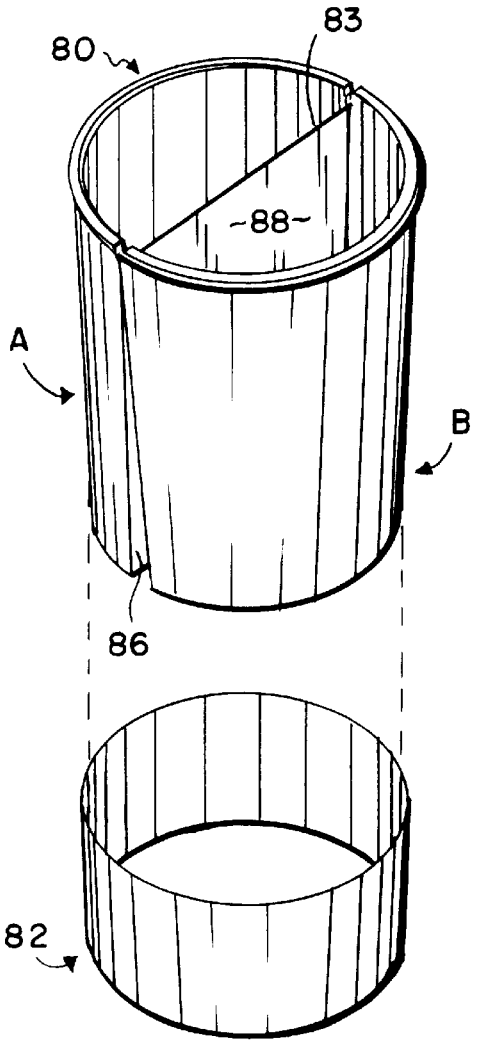
FIG. 6 is an exploded perspective view of an alternative embodiment of the inventive cup utilizing a securing flange or lip in conjunction with an exteriorly attached sleeve to hold the container halves together.

Referring to FIG. 6, an alternative embodiment is shown wherein halves A & B are secured together through use of containment sleeve 82 as a compression means to form container 80. In the embodiment of FIG. 6, halves A & B may be partially connected at top edge 83 by the inclusion of hinge of unitary construction with mateable wall 86 and mateable wall 88. Alternatively, container half A and container half B may be formed as described in the previous embodiments with the use of sleeve 82 to further secure container half A and half B. Halves A & B of the embodiment of the embodiment of FIG. 6 may include the indent and bead arrangement previously described for the embodiments of FIGS. 1 to 5 or may only incorporate curved flange 94 shown in FIG. 7.

In the embodiment of FIG. 6, halves A & B are fitted together such that mateable walls 86 and 88 are opposed to one another and then sleeve 82 is pushed upwardly from the bottom to hold halves A & B securely together. Sleeve 82 can be open at the bottom as shown in FIG. 6 or a-bottom may be included in sleeve 82.

Figure 7:
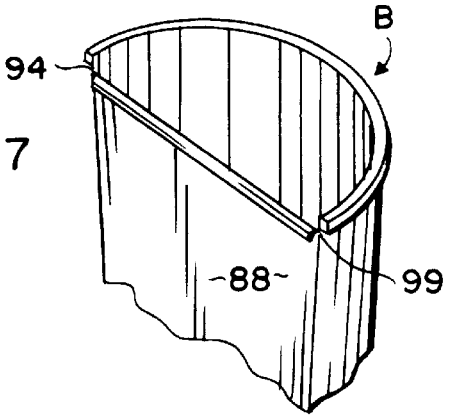
FIG. 7 is a fragmentary perspective view of one half of the embodiment of FIGS. 6 & 8 showing the securing flange on the container half for securing the upper portion of one container half to the second container half.

Referring to FIG. 7, a perspective fragmentary view of container half B is shown having curved flange 94 along top edge 99 of mateable wall 88 of container half B. This configuration of half B may be used as a component of the embodiments presented in FIGS. 6 & 8. In FIG. 7, container half B with curved connection flange 94 operates as previously described to capture the top edge of mateable wall 86 of half A. After such interconnection with the opposing mateable wall of the complemental container half, container sleeve 82, shown in FIG. 6, may be used to secure together to lower portions of container half A to container half B.

Figure 8:
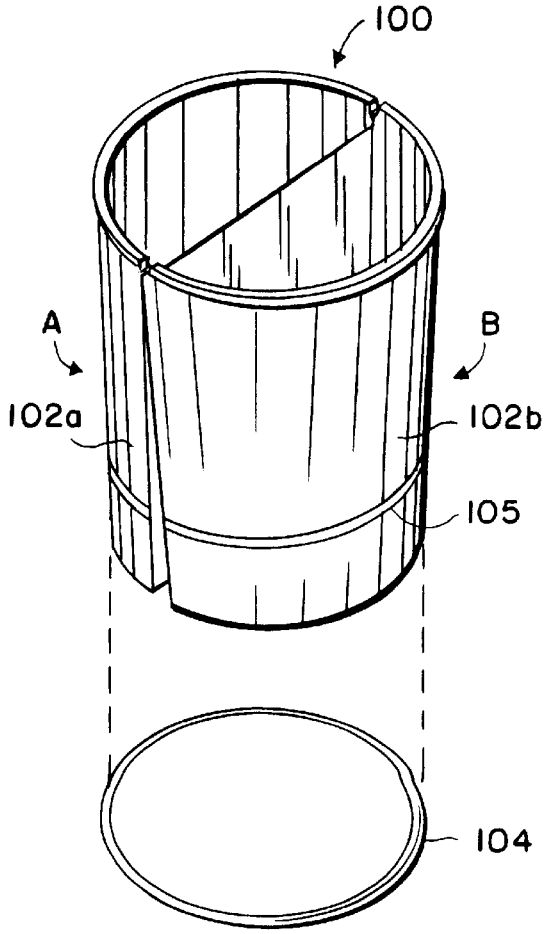
FIG. 8 is an exploded perspective view of an alternative embodiment of the inventive cup utilizing the securing flange or lip in conjunction with an exterior securing ring to hold the container halves together.

Alternatively, as shown in FIG. 8, a securing ring 104 may be pressed upwardly to surround outer wall 102*a* of half A and outer wall 102*b* of half B to compressively secure together halves A & B into the complete container 100. Securing ring 104 may simply rest on outer walls 102*a*, 102*b* or may seat within groove 105 which can be formed in outer walls 102*a*, 102*b* of sections A & B.

Certain changes may be made in embodying the above invention, and in the construction thereof, without departing from the spirit and scope of the invention. It is intended that all matter contained in the above description and shown in the accompanying drawings shall be interpreted as illustrative and not meant in a limiting sense.

It is to be understood that the following claims are intended to cover all generic and specific features of the invention herein described, and all statements of the scope of the invention which, as a matter of language, might be said to fall therebetween.

What is claimed as new and desired to secured by Letters Patent is as follows:

1. A container for holding solid and liquid foods in separated fashion comprising:

a first storage section having at least one sidewall for mateable connection to a complemental sidewall of a second storage section, a flange on a top edge of said first section sidewall for capture thereunder of a top edge of said complemental sidewall, and a means for compressing said first section against said second section to form a container such that when said first section or said second section is grasped by a user the section compressed thereto remains in attachment to provide said formed container with a divided interior.

2. The container as claimed in claim 1 wherein said means for compressing is a sleeve having a cylindrical wall for receiving therein said first and second sections to form a container and said sleeve having a bottom connecting said cylindrical wall for supporting said container.

3. The container as claimed in claim 1 wherein said means for compressing is a ring for receiving therein said first and second sections to form a container.

4. The container as claimed in claim 1 wherein said capture of a top edge of said complemental sidewall by said flange operates to provide hinged connection between said first and second sections to permit stacking of containers one within another.

* * * * *